US005357745A

United States Patent [19]

Probert

[11] Patent Number: 5,357,745

[45] Date of Patent: Oct. 25, 1994

[54] COMBUSTOR CAP ASSEMBLY FOR A COMBUSTOR CASING OF A GAS TURBINE

[75] Inventor: George W. Probert, Clifton Park, N.Y.

[73] Assignee: General Electric Company, Schenectady, N.Y.

[21] Appl. No.: 214,053

[22] Filed: Mar. 15, 1994

Related U.S. Application Data

[63] Continuation of Ser. No. 859,005, Mar. 30, 1992, abandoned.

[51] Int. Cl.[5] ..... F23R 3/46

[52] U.S. Cl. ..... 60/39.37; 60/747; 60/754

[58] Field of Search ..... 60/39.37, 733, 740, 60/746, 752, 754, 756, 747; 431/284, 285

[56] References Cited

U.S. PATENT DOCUMENTS

| | | | |
|---|---|---|---|
| 2,608,057 | 8/1952 | Boyd et al. . | |
| 2,676,460 | 4/1954 | Brown | 60/39.37 |
| 2,729,938 | 1/1956 | McDowall et al. . | |
| 2,801,520 | 8/1957 | Highberg . | |
| 2,813,397 | 11/1957 | Fisher et al. | 60/39.37 |
| 3,086,363 | 4/1963 | Fiori . | |
| 3,991,562 | 11/1976 | Nelson et al. | 60/747 |
| 4,151,713 | 5/1979 | Faitani et al. | 60/747 |
| 4,180,974 | 1/1980 | Stenger et al. | 60/756 |
| 4,292,801 | 10/1981 | Wilkes et al. | 60/733 |
| 4,365,477 | 12/1982 | Pearce | 60/756 |
| 4,573,315 | 3/1986 | Stroem . | |
| 4,695,247 | 9/1987 | Enzaki et al. | 60/756 |
| 4,843,825 | 7/1989 | Clark | 60/39.37 |
| 5,012,645 | 5/1991 | Reynolds | 60/754 |
| 5,117,637 | 6/1992 | Howell et al. | 60/740 |
| 5,127,221 | 7/1992 | Beebe | 60/733 |
| 5,129,231 | 7/1992 | Becker et al. | 60/756 |
| 5,235,478 | 10/1993 | Thibault, Jr. et al. | 60/747 |
| 5,253,471 | 10/1993 | Richardson | 60/754 |

FOREIGN PATENT DOCUMENTS

| | | | |
|---|---|---|---|
| 0488557A1 | 6/1992 | European Pat. Off. . | |
| 2384112 | 10/1978 | France . | |
| 260957 | 4/1949 | Switzerland . | |
| 812404 | 4/1959 | United Kingdom | 60/39.37 |
| 892949 | 4/1962 | United Kingdom . | |
| 1539035 | 1/1979 | United Kingdom . | |

*Primary Examiner*—Timothy S. Thorpe
*Attorney, Agent, or Firm*—Nixon & Vanderhye

[57] ABSTRACT

A combustor cap assembly for a gas turbine includes an outer sleeve (12); an impingement plate (14) fixed to a forward end of the outer sleeve. The impingement plate is provided with a plurality of primary fuel nozzle openings (18) and a single secondary fuel nozzle opening (20). A plurality of open-ended nozzle cups (28) are fixed to the impingement plate (14) in alignment with respective primary fuel nozzle openings (18); and a nozzle collar (32) is fixed to a rearward end of each nozzle cup (28).

7 Claims, 3 Drawing Sheets

COMBUSTOR CAP ASSEMBLY FOR A COMBUSTOR CASING OF A GAS TURBINE

This is a continuation of U.S. application Ser. No. 07/859,005 filed on Mar. 30, 1992, now abandoned.

TECHNICAL FIELD

This invention relates to gas and liquid fueled turbines, and more specifically, to combustors in industrial gas turbines used in power generation plants.

BACKGROUND ART

Combustor cap assemblies have evolved over the years from a single fuel nozzle configuration to a multi-nozzle dry low NOx configuration with dual burning zone capability. The cost of combustion hardware has increased proportional to the mechanical complexity associated with the enhanced performance and lower emissions goals of modern combustion systems.

The function of the cap primary nozzle cup assembly is to deliver fuel and air from the fuel nozzle and end cover assembly to the primary zone of the combustor. Air and fuel pass axially through each primary nozzle cup. Air passes through the sidewalls of each primary cup in a radially inward direction, providing cooling for the cup wall. Air also passes through multiple apertures in the cap impingement plate thereby cooling the plate and supplementing the total cap airflow.

The current dry low NOx combustor cap configuration consists of many sheet metal and machined parts in a welded and brazed assembly. The disadvantages of this assembly are:

(1) The cost of manufacturing of multiple parts continues to increase;

(2) Assembly costs are high as many processes are involved; and (3) Manufacturing cycle time is excessive and precludes production of a volume of assemblies in a limited capacity shop.

DISCLOSURE OF INVENTION

The objective of this invention is to reduce the cost of dry low NOx combustor cap assemblies within the following constraints:

(1) The cap assembly must continue to function aerodynamically without performance compromise;

(2) The mechanical integrity of the cap must be maintained; and (3) The cap must physically fit as a replacement part without mechanical or performance impact or required alteration of any other component of the gas turbine combustion system.

In accordance with an exemplary embodiment of the invention, a unique dry low NOx combustor cap assembly is provided which has a significantly reduced number of parts per assembly, for example, 27 parts versus 45 parts for a six nozzle cap assembly, In this exemplary embodiment, the assembly includes a generally cylindrical outer cap sleeve adapted for attachment to a combustor casing in a known manner. The outer sleeve receives within its open forward (or downstream) end, i.e., the end closest to the combustion zone in the combustor, a circular, disk-like impingement plate provided with a forwardly extending outer annular ring which fits snugly into the sleeve and is fixed (for example, by welding) thereto. The impingement plate is also formed with, in the exemplary embodiment, six relatively large primary nozzle openings, arranged in a circular array about the center axis of the assembly, and about a larger secondary nozzle opening in the center of the plate.

Each of the primary nozzle openings is defined by a tapered entry portion, while the secondary nozzle opening is defined by a rearwardly extending annular inner ring. Substantially the entire surface of the impingement plate, with the exception of the inner and outer rings, is formed with a plurality of relatively small cooling apertures.

A primary nozzle cup, provided in the form of an open-ended, tapered tubular component, is fixed to the rearwardly facing free edge of each primary nozzle opening, with the nozzle cup tapering radially inwardly in the rearward direction. The forwardmost axial portion of the cup is also provided with an array of cooling apertures, forming an essentially unbroken pattern of cooling apertures with those in the tapered entry portion of the impingement plate.

A radially outwardly extending, annular cup ring is fixed to the rearward edge of each cup, thereby providing a mounting flange for a nozzle collar as described below.

The sleeve-like nozzle collar has a similar radial flange on its forward end which is adapted to butt against the cup ring annular flange, with the collar opening and cup opening in substantial alignment. An annular collar retainer ring, having axial and radial portions, is fixed to the cup ring, with the radial portion overlapping the collar flange to hold the collar against the cup.

The present invention may thus be described in its broader aspects as providing a combustor cap assembly comprising an outer sleeve; an impingement plate fixed to a forward end of the outer sleeve, the impingement plate formed with a plurality of primary fuel nozzle openings and a single secondary fuel nozzle opening; a plurality of open-ended nozzle cups fixed to the impingement plate in alignment with respective primary fuel nozzle openings; and a plurality of nozzle collars fixed to respective rearward ends of the nozzle cups.

The above described construction is of considerably less complex construction and far less costly to manufacture than prior combustor cap assemblies, but without compromising performance. The cap is easily removed from the combustor for repair and/or replacement, and does not require alteration of any other components of the combustion system.

Other objects and advantages of the invention will become apparent from the detailed description which follows.

BEST MODE FOR CARRYING OUT THE INVENTION

Figure 1:
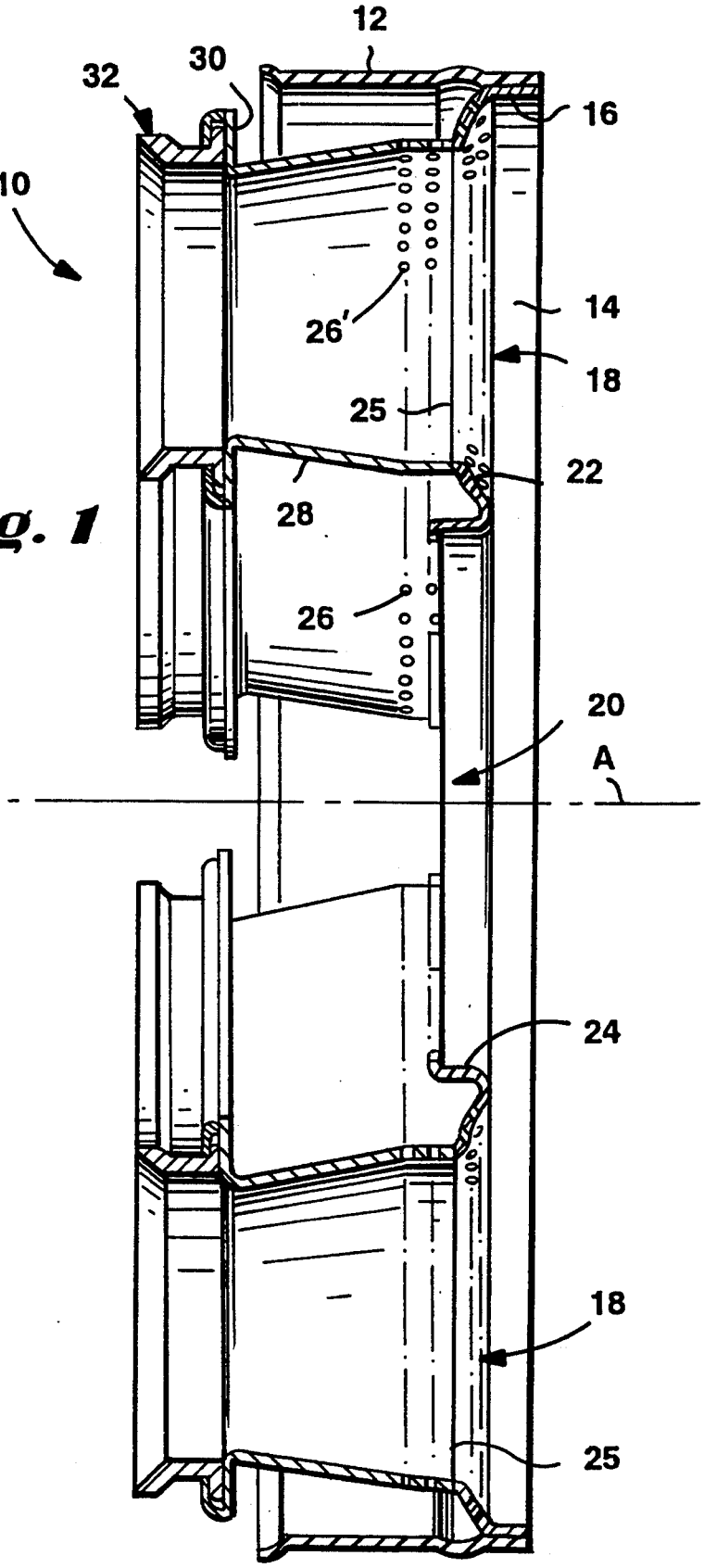
FIG. 1 is a side section of a liner cap assembly in accordance with an exemplary embodiment of the invention.
Figure 2:
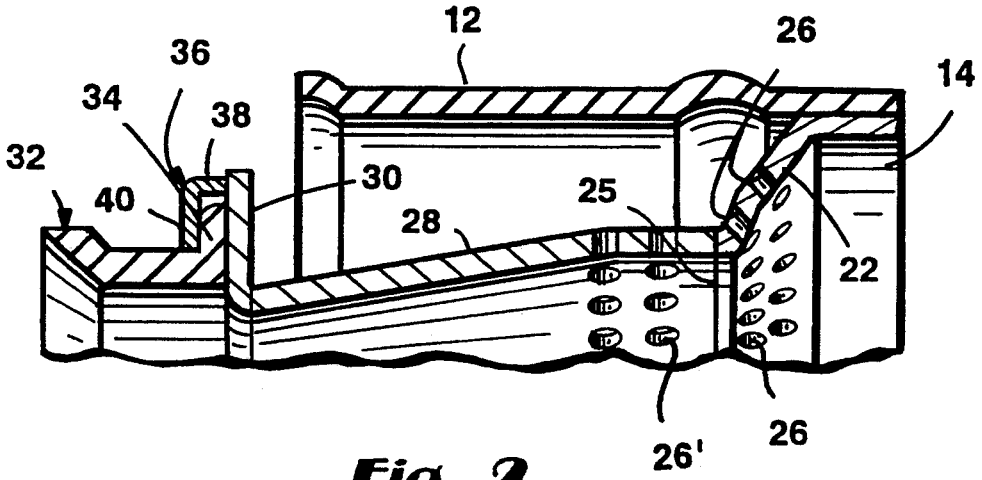
FIG. 2 is an enlarged detail of a portion of the sectional view illustrated in FIG. 1.
Figure 4:
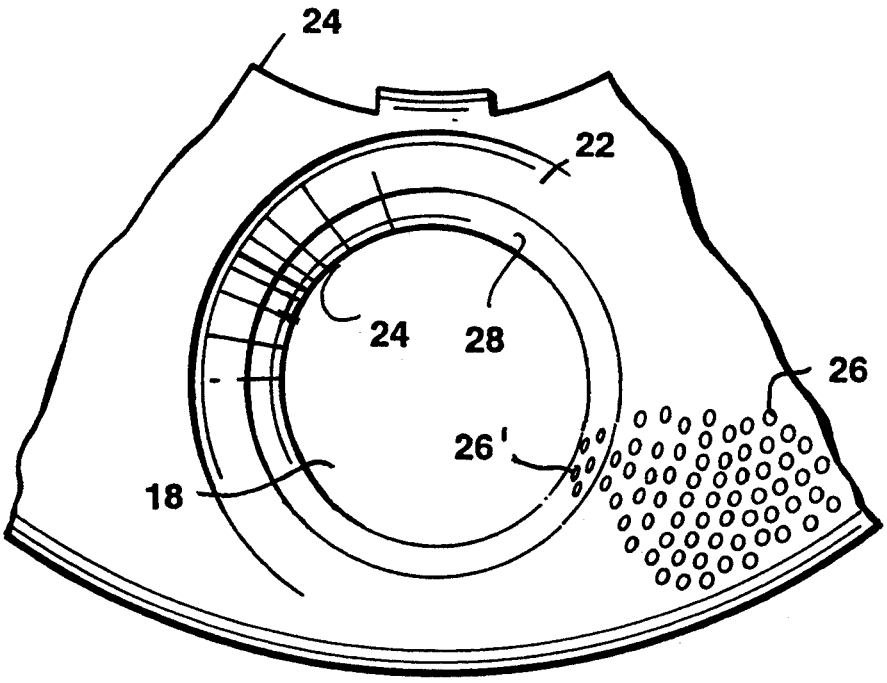
FIG. 4 is a partial front elevation of the assembly illustrated in FIG. 1.

With reference to the drawings, particularly FIGS. 1 and 2, the combustor cap assembly 10 in accordance with the exemplary embodiment of the invention includes a generally cylindrical, open-ended cap sleeve 12, which is adapted for connection by any suitable means, such as bolts, to the combustor casing assembly (not shown).

Figure 3:
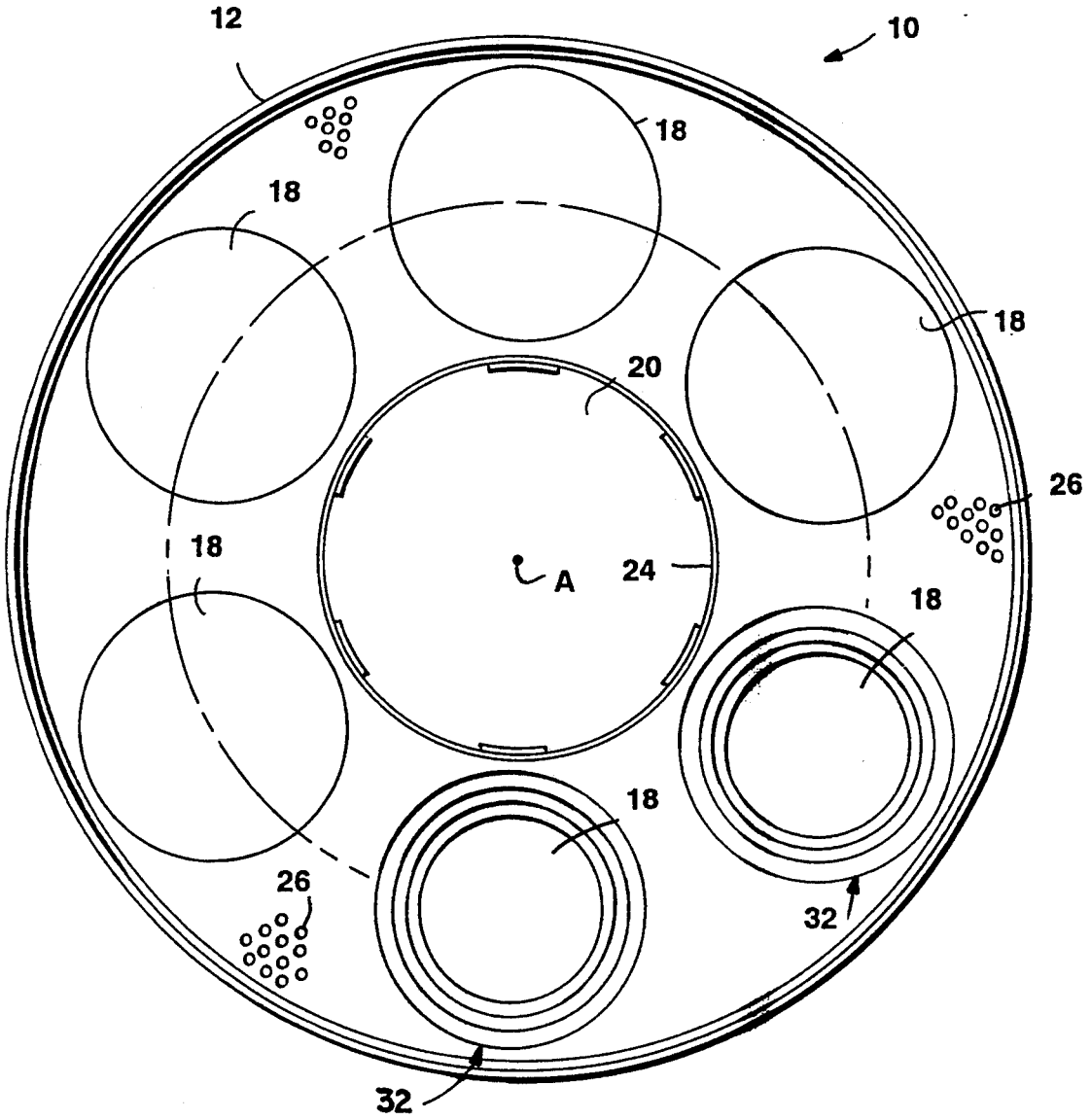
FIG. 3 is a rear elevation of the assembly illustrated in FIG. 1.

The cap sleeve 12 receives within its forward open end an impingement cooling plate 14 which includes a forwardly extending, outer annular ring portion adapted to frictionally engage, and be welded to, the inner surface of sleeve 12. The impingement plate also includes, in the exemplary embodiment, six primary fuel nozzle openings 18, and a single, centrally located secondary fuel nozzle opening 20, best seen in FIG. 3. The circular openings 18 are arranged in a circular array about the center axis A and about the circular secondary nozzle opening 20. For each opening or hole 18, there is an inwardly and rearwardly extending inclined or tapered plate portion 22 which defines the openings 18. The impingement plate center hole 20 has an inner annular ring 24 welded thereto, extending rearwardly, or away from the combustion zone. The manner in which the primary nozzles and single secondary nozzle are fitted within the respective openings 18 and 20 forms no part of this invention.

The impingement cooling plate 14, including the tapered portions 22 and all areas between the primary fuel nozzle openings 18 (but excluding the inner and outer annular rings 16 and 24) is formed with an array of cooling apertures 26, extending over substantially the entire surface thereof. Air flowing through the impingement plate 14 serves to cool the plate and to supplement the total cap assembly airflow used in the combustion process.

The primary nozzle cups 28 are best seen FIGS. 1 and 2, are each comprises an open ended tubular member, with an inwardly tapered surface extending in a rearward direction, welded to the rearwardly facing free edge 25 (FIG. 2) of a tapered portion 22 (of a impingement plate 14) of a respective opening 18. The forward end portion of each cup 28 is provided with cooling apertures 26'. To the rearwardmost edge of each cup 28, there is fixed (by welding, for example) a radially outwardly extending cup flange 30. An annular nozzle collar 32 formed with a radial mounting flange 34 (FIG. 2) is butted up against the cup flange 30 and the collar 32 is secured to the cup 28 by means of an annular collar retainer 36 welded in place after the nozzle collar 32 is properly oriented vis-a-vis the cup flange 30. The collar retainer 36 has axial and radial portions 38, 40, respectively, such that portion 38 may be welded to the cup flange 30 and portion 40 extends radially inwardly to overlap the mounting flange 34 of the collar 32, thereby precluding separation of the cup 28 and collar 32.

There may be provided a slight annular gap between the mounting flange 34 and axial portion 38 of the collar retainer ring 36 in order to provide a degree of self-adjustability of the collar 32 relative to an associated primary nozzle (not shown) to account for any slight misalignment and/or tolerance build-up during assembly of the combustor.

The various components as described above are preferably secured by welding. All components in the exemplary embodiment are preferably made from 0.062 inch thick Hastalloy-X sheet with the following exceptions. The nozzle collars are machined from 403SS bar stock, and the nozzle collar retainers are 0.045 inch thick Hastalloy-X sheet.

The above described exemplary embodiment (for a six nozzle combustor) has 40% fewer parts (27 versus 45 in the currently used cap assembly), with eighteen fewer welds. As a result, cost is significantly reduced, while at the same time, preliminary tests indicate NOx emission levels as low and possibly lower than current cap assemblies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor cap assembly comprising:

an outer sleeve;

an impingement cooling plate fixed within and to a forward end of the outer sleeve, the impingement cooling plate formed with a plurality of primary fuel nozzle openings arranged in a circular array about a center axis of the assembly, a single centrally located secondary fuel nozzle opening, and a plurality of cooling apertures smaller than said primary and secondary nozzle openings and adapted to permit combustion air to flow therethrough and thereby cool said impingement cooling plate;

a plurality of open-ended, tubular nozzle cups fixed to the impingement plate in alignment with corresponding ones of said primary fuel nozzle openings; and a plurality of annular nozzle collars fixed to respective rearward ends of said tubular nozzle cups.

2. The combustor cap assembly of claim 1 wherein said impingement cooling plate is provided with a first axially extending outer annular ring about its outer periphery, and a second axially extending inner annular ring extending about said secondary nozzle opening.

3. The combustor cap assembly of claim 2 wherein said outer annular ring is telescopically received within said forward end of said sleeve.

4. The combustor cap assembly of claim 1 wherein each nozzle cup has a forward portion provided with an array of cooling apertures.

5. The combustor cap assembly of claim 1 wherein each nozzle cup is provided with a radial flange at a rearward end thereof, and each of said nozzle collars is provided with a corresponding radial flange in abutting relationship with said cup radial flange.

6. The combustor cap assembly of claim 5 wherein an annular collar retainer is fixed to each cup radial flange in overlapping relationship to said collar radial flange to thereby hold the collar against the cup.

7. The combustor cap assembly of claim 6 wherein said annular collar retainer is movable relative to said cup.

* * * * *